United States Patent [19]

Curtis

[11] 4,395,938

[45] Aug. 2, 1983

[54] GAS CYLINDER PLUG FOR A GAS OPERATED MACHINE GUN

[75] Inventor: George F. Curtis, Sanford, Me.

[73] Assignee: Maremont Corporation, Carol Stream, Ill.

[21] Appl. No.: 193,835

[22] Filed: Oct. 3, 1980

[51] Int. Cl.[3] ..... F41D 5/04

[52] U.S. Cl. ..... 89/193

[58] Field of Search ..... 89/193

[56] References Cited

U.S. PATENT DOCUMENTS 853,715 5/1907 Mondragon ..... 89/193

2,783,685 3/1957 Green ..... 89/193

*Primary Examiner*—Stephen C. Bentley

*Attorney, Agent, or Firm*—Allegretti, Newitt, Witcoff & McAndrews, Ltd.

[57] ABSTRACT

Improvements to the M60 7.62-mm machine gun (1) to enable it to be cocked after the cover assembly has been closed without opening the latter (2) to minimize the possibility of a runaway gun (3) to enable a hot barrel to be changed without the necessity of using protective hand coverings (4) to eliminate the necessity of providing a bipod support assembly for every spare barrel (5) to provide for better control of the gun when firing from a standing position and (6) to simplify the construction of the gas cylinder and piston.

2 Claims, 8 Drawing Figures

GAS CYLINDER PLUG FOR A GAS OPERATED MACHINE GUN

FIELD OF THE INVENTION

This invention relates to improvements in air-cooled, belt-fed, gas-operated machine guns. More particularly, it relates to improvements in the M60 7.62-mm machine gun described in detail in the Department of the Army Field Manual FM 23-67, dated October 1964.

BACKGROUND OF THE INVENTION

The M60 machine gun is an excellent weapon but improvements are possible and desirable. In particular, there are certain areas where improvements are especially desirable.

The M60 machine gun has its feeding mechanism arranged in a pivoted cover which is raised to load a belt of cartridges into the gun and then closed to render the feeding mechanism operative. The feeding mechanism includes cam means operated by the reciprocating bolt assembly which must be in its rearward position for proper engagement of the cam follower carried by the assembly with the cam means of the feeding mechanism when the cover is moved to closed position. Thus, when the bolt assembly is in its forward position with the cover open, if the latter is closed the bolt assembly cannot be moved rearwardly to cock the gun and if it is forced rearwardly there is a possibility of the cam follower thereon actually damaging the feeding mechanism. Thus, the present construction presents a possibility not only of damage to the feeding mechanism but also of a dangerous battle situation because of undue delay in cocking the weapon because the gunner must open the cover before he can retract the bolt assembly to cock the gun and then must reclose the cover before he can fire.

As mentioned above, the M60 machine gun is gas-operated. On occasion, for various reasons, gas pressure is insufficient to move the bolt assembly to its full rearward position for cocking engagement with the sear of the trigger mechanism. Even though the bolt assembly is not moved to its full rearward position, however, gas pressure may be sufficient to move the assembly rearwardly a distance sufficient to cause the feeding mechanism to feed another cartridge into position to be transferred by the bolt assembly into the barrel chamber and subsequently fired. The foregoing situation results in a runaway gun, i.e., it will continue to fire even though the trigger is released; manifestly a dangerous situation.

On prolonged firing, the barrel of the M60 machine gun becomes quite hot and for continued use must be replaced by the usual spare. To enable rapid replacement without delay, heat-insulating protective hand coverings, such as asbestos mittens, now are employed for removal of a hot barrel. The use of such mittens not only is an expensive nuisance but also contributes to delay in barrel replacement.

The M60 machine gun also is provided with a bipod support assembly secured to the barrel. The assembly is not readily detachable and removable from the barrel. Consequently barrel spares normally are provided with such bipod support assemblies, thus necessitating the provision of more than one bipod support assembly for each gun.

The gas-operated piston and cylinder of the M60 machine gun also is somewhat bulky and inaccessible for cleaning. The cylinder is provided with a cleaning port aligned with the barrel gas port, with the cleaning port being closed by a threaded plug. The forward end of the cylinder is closed by an extension held in place by a clamp nut with a lock washer. Both the plug and the extension of the cylinder are retained against loss by lock wires because the usual threads and lock nuts fail under extreme heat conditions. Since lock wires cannot be replaced readily in the field, the gas system is cleaned only infrequently with resulting possible sluggish operation of the gun. Furthermore, the cleaning port plug sometimes is lost and the gun thereby rendered inoperative because of loss of adequate gas pressure.

The rearward end of the gas cylinder is provided with interior threads engaged by exterior threads on a nut to provide a forwardly facing shoulder engageable by the piston on its rearward travel. Both this nut and the cylinder extension unnecessarily complicate the construction of the cylinder and piston arrangement and add unnecessary weight to the weapon.

It also has been found that control of the gun is difficult when firing from a standing position.

SUMMARY OF THE INVENTION

It is therefore an object of this invention to provide an improved feeding mechanism for the M60 machine gun which will enable the cover to be moved from open to closed positions while the bolt assembly is in its forward position and the bolt assembly subsequently to be moved to its rearward position to cock the gun with operative engagement of the cam follower thereon with the feeding cam means on the cover without opening the cover. Such improvement not only avoids the possibility of damage, as described above, but also avoids delay in cocking the gun in an emergency.

It is another object of this invention to provide an improved sear and notch means for the M60 machine gun which will reduce and minimize the possibility of a runaway gun.

It is another object of this invention to provide a carrying handle for the M60 machine gun that is secured to the barrel and which can be used for handling a hot barrel without the necessity for heat-insulating protective hand coverings, thus avoiding the expensive nuisance and delay attendant the use of such coverings.

It is another object of this invention to provide an M60 machine gun with a bipod support assembly that is secured to a fixed portion of the gun other than the barrel, so that the provision of a bipod support assembly for each barrel is unnecessary and only one such assembly need be provided for each gun.

It is another object of this invention to provide the M60 machine gun with an improved lightweight pistol grip detachably secured to the bipod support assembly in order to give improved control when firing, especially when firing from the hip or shoulder when standing or walking.

It is a further object of this invention to provide an improved and simplified gas-operated cylinder and piston construction which eliminates the necessity for lock wires and facilitates cleaning in the field while reducing the possibility of loss of parts required for operation of the gun and simplifying the entire construction and making it lighter in weight.

Other objects and advantages of the invention will become evident from the following detailed description and accompanying drawings in which:

DETAILED DESCRIPTION OF THE INVENTION

Figure 1A:
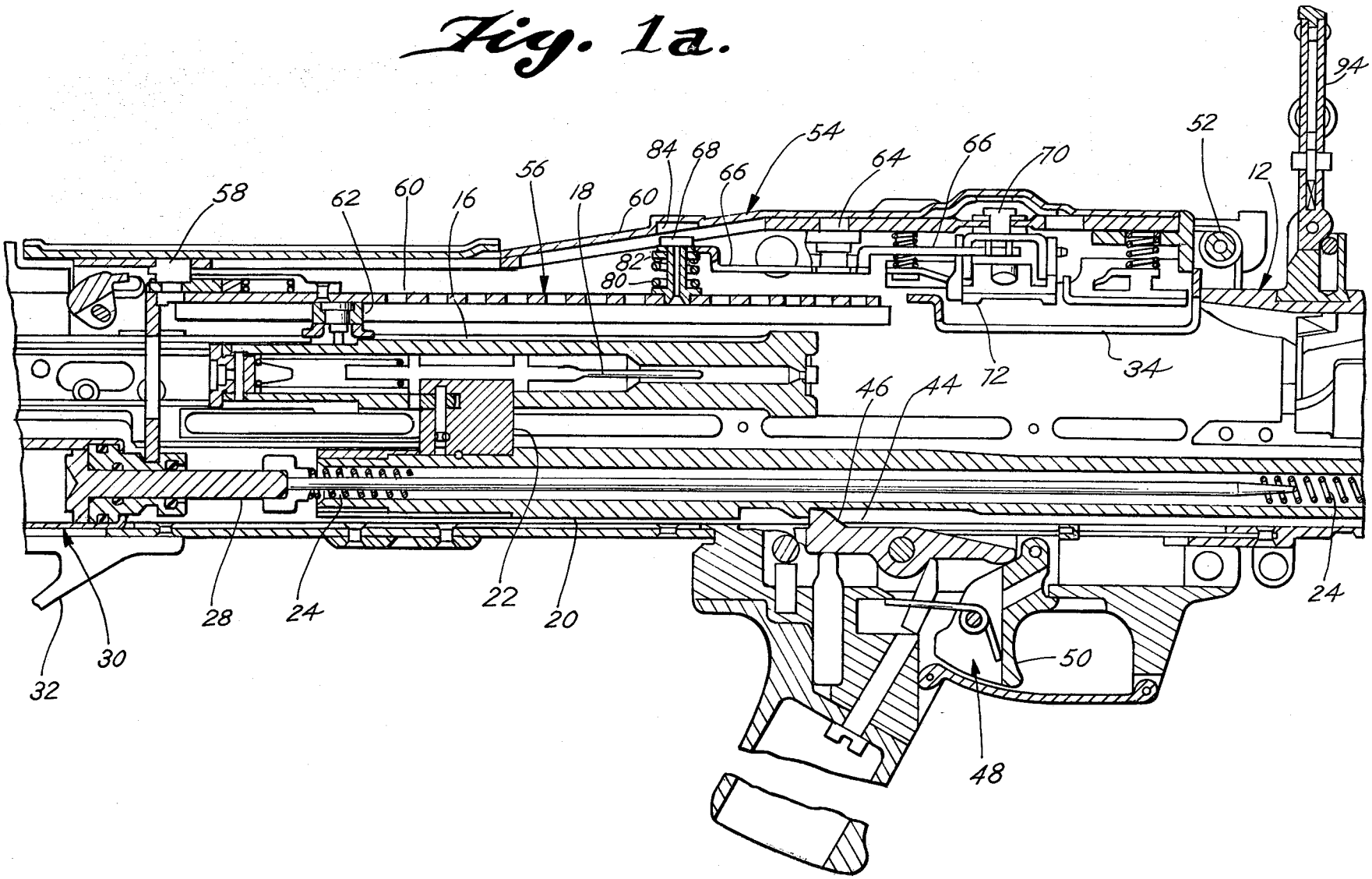
FIGS. 1A and 1B constitute related generally longitudinal vertical sectional views through adjacent portions of a machine gun embodying this invention.
Figures 1B, 1C:
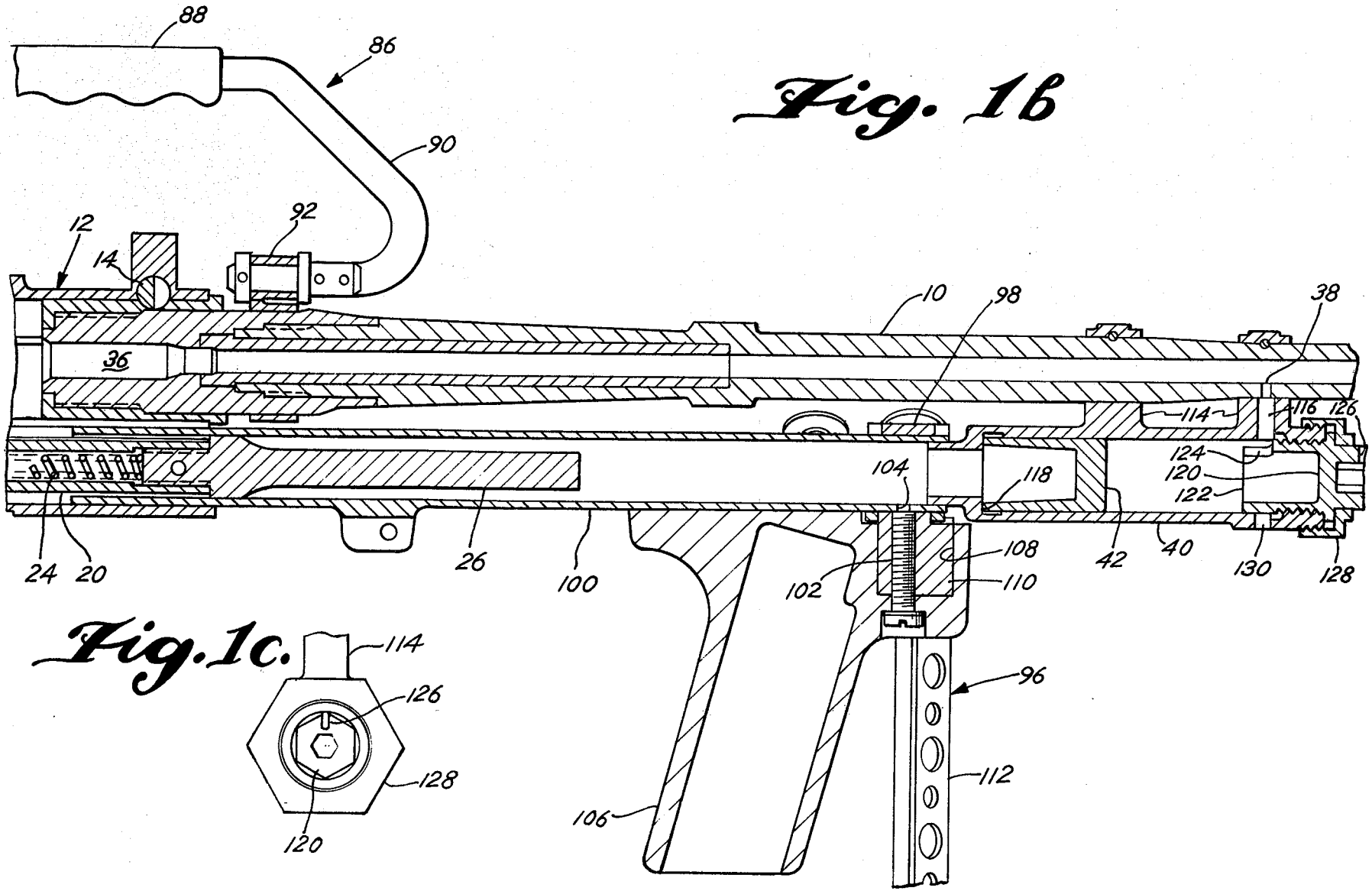
FIG. 1C is a fragmentary view of the forward end of the gas cylinder shown in FIG. 1B.
Figure 2:
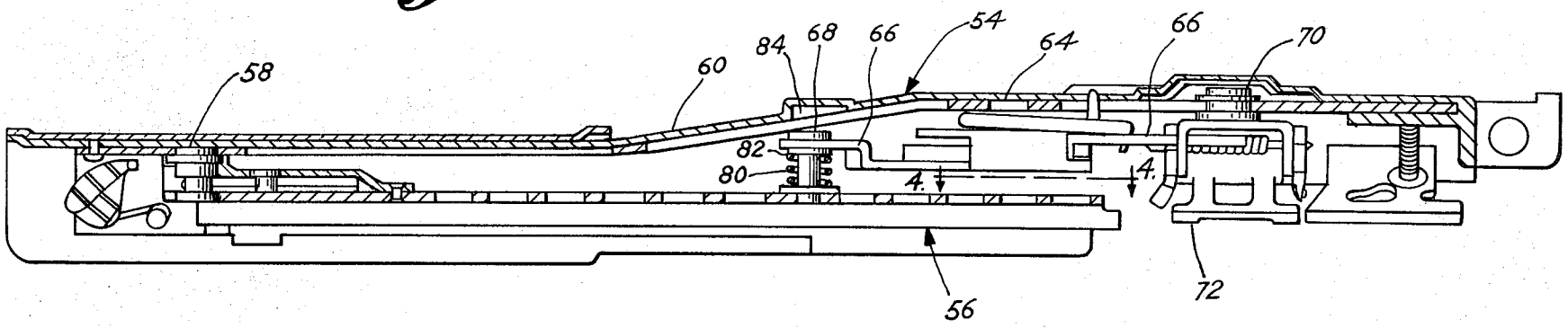
FIG. 2 is a side view, partly in vertical section, of the cover mechanism shown in FIG. 1A.
Figure 3:
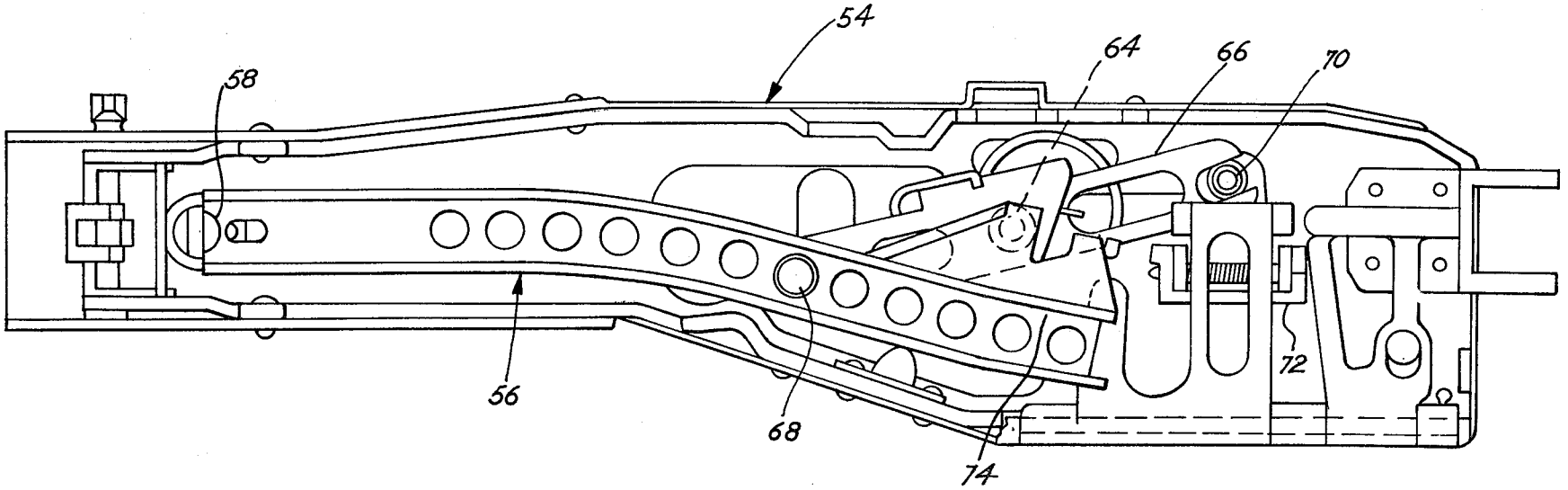
FIG. 3 is a view of the underside of the cover mechanism shown in FIG. 2.
Figure 4:
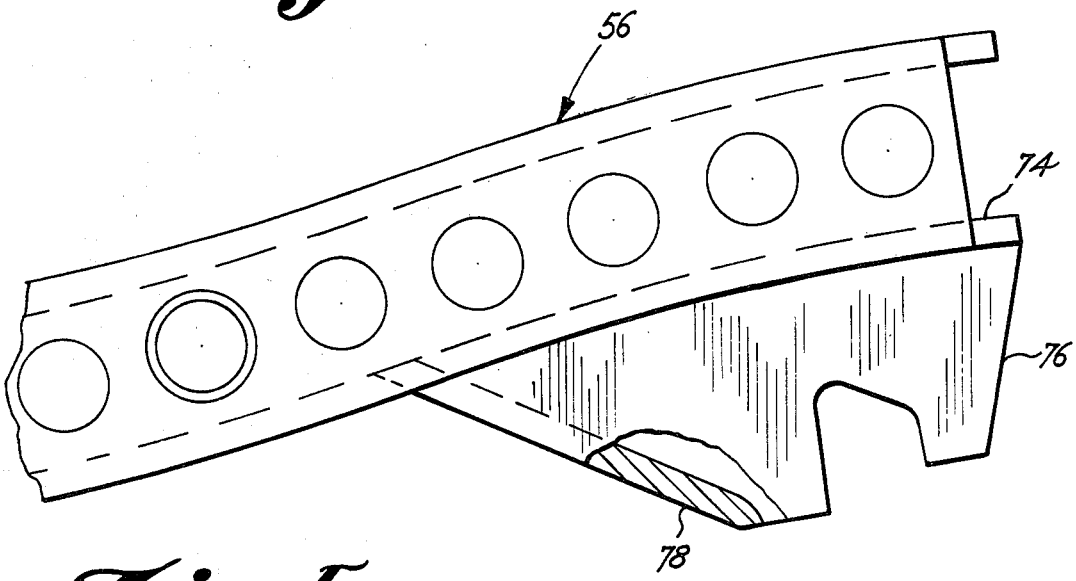
FIG. 4 is an enlarged fragmentary top view, partly broken away, taken on line 5—5 of FIG. 3.
Figure 5:
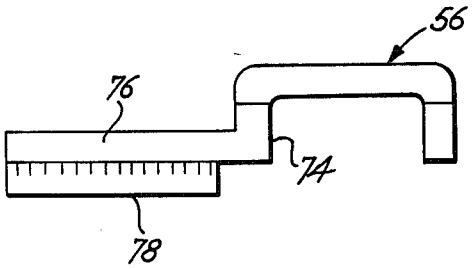
FIG. 5 is an end view taken from the right hand end of FIG. 4.
Figure 6:
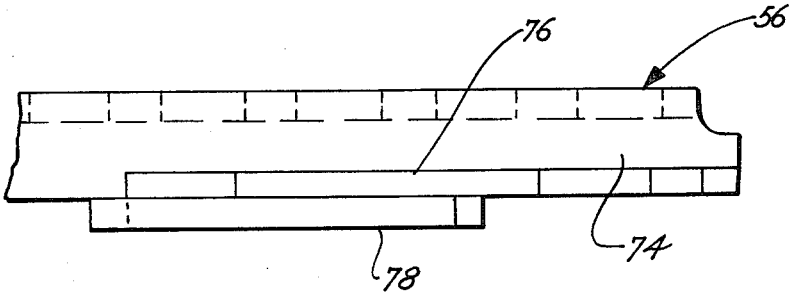
FIG. 6 is a side view of the part shown in FIG. 4.

Referring now to FIGS. 1A and 1B of the drawings, there is shown a machine gun having a barrel 10 with its breech end detachably locked within a receiver assembly 12 by a rotatable lock pin 14. Mounted for repetitive cycles of reciprocating movement in the receiver assembly 12 is a bolt assembly 16 having a firing pin 18 coaxially mounted therewithin, the bolt assembly 16 is connected to a lower parallel hollow operating rod 20 by a yoke 22. The operating rod 20 is constantly urged forwardly, to move the bolt assembly forwardly by a coil compression drive spring 24 disposed within the rod and engaged between a solid extension 26 closing the forward end of the rod and the piston rod 28 of a buffer assembly 30 disposed within the gun stock 32. Carried on the receiver assembly 12 to the rear of the barrel 10, is a feed tray 34 for receiving and guiding a belt of linked cartridges (not shown) into position wherein the leading cartridge may be engaged by the bolt assembly 16, on its forward movement, fed into the chamber 36 of the barrel 10, and then fired by the firing pin 18.

The bolt assembly 16 is moved rearwardly, for another feeding and firing movement and to extract a spent cartridge after firing, by the operating rod 20 which is moved rearwardly by the development of gas pressure in the barrel 10, on the firing of a cartridge, which is communicated through a gas port 38 therein into a cylinder 40 secured to, beneath and parallel with, the barrel. A piston 42 is reciprocable in the cylinder 40 and is moved rearwardly by the gas pressure to engage the solid extension 26 of the operating rod 20 and forcibly move the rod rearwardly. When the rod 20 reaches its rearmost position, a notch 44 in the underside thereof is engaged by a sear 46 of the trigger mechanism 48, which is releasable by a trigger 50, to cock the gun. A cocking handle (not shown) is secured to the operating rod 20 and projects outwardly through a slot in the right hand side of the receiver assembly 12 to enable the gun to be cocked manually.

Pivotally mounted to the receiver assembly 12, for upward swinging movement from a closed firing position (shown in FIG. 1A) to an open loading position (not shown) about a pivot pin 52 secured to the receiver assembly adjacent the rear end of the barrel 10, is a cover assembly 54 which contains mechanism for feeding a belt of cartridges (not shown) step-by-step over the feed tray 34 to present the leading cartridge in a position to be engaged and fed into the barrel chamber 36 as aforesaid. The feeding mechanism includes feed cam means 56 in the form of an inverted trough extending generally longitudinally of the gun and pivotally secured at its rearward end, by a stud 58 depending from the top 60 of the cover assembly 54, for lateral oscillating movement. The feed cam means 56 has engaged in the trough thereof a cam roller or follower 62 secured to and projecting upright from the bolt assembly 16 so that reciprocating movements of the latter oscillate the feed cam means. Also secured to the cover assembly 54 for oscillating movement about a stud 64 depending from the top 60 thereof is a feed cam lever 66 having the rear end thereof provided with a slot engaged with an upright stud 68 on the feed cam means 56. Consequently, the feed cam lever 66 is oscillated by oscillation of the feed cam means 56. The forward end of the feed cam lever 66 has slotted engagement with a stud 70 on a reciprocating belt feed pawl 72. Thus, oscillation of the feed cam lever 56 feeds a belt of cartridges forwardly step-by-step to bring the leading cartridge into position to be engaged and fed into the barrel chamber 36 by the bolt assembly 16. The aforedescribed mechanism is known and described in the aforementioned Army Field Manual, so no further detailed description thereof is necessary here.

As mentioned before, the M60 machine gun, when the bolt assembly 16 is moved forward with the cover assembly 54 open and the latter then closed, cannot thereafter be cocked manually without first opening the cover assembly because with the latter closed the forward end of the feed cam means 56 is not in a position to be operatively engaged by the cam roller or follower 62 on the bolt assembly. Thus, in order to cock the weapon, the cover assembly 54 has to be opened, the bolt assembly 16 pulled to the rear manually and cocked, and the cover assembly then closed to render the weapon operative for firing. Under these circumstances, a gunner sometimes attempts to cock the weapon without opening the cover assembly 54 and applies considerable force in such an effort. The result is possible damage to the weapon, which will render it inoperative.

The aforementioned disadvantages are overcome by the present improvement wherein the forward end of the feed cam means 56 is contoured to be engaged by the cam roller or follower 62 when the cover assembly is closed with the bolt assembly 16 in its forward position so that rearward movement of the bolt assembly pivots the feed cam means into position to be operatively engaged by the cam roller or follower. Thus, the forward end of the feed cam means 56 has extending laterally from one side thereof, flush with the lower edge of one side wall 74 of the trough, a flange 76 having depending therefrom at the rearward edge thereof, a forwardly inclined cam rib 78. As later explained, the feed cam means 56 is arranged so that its forward end, in advance of the rear pivot stud 58, can yield somewhat upwardly relative to the top 60 of the cover assembly 54. Thus, when the bolt assembly 16 is in its forward position, and the cover assembly 54 moved from open to closed position, the laterally extending flange 76 on the feed cam means 56 engages with the top of the upstanding cam roller or follower 62 on the bolt assembly, and the forward end of the feed cam means yields upwardly to accommodate such engagement and enable the cover assembly to be closed completely. When the bolt assembly 16 is then moved manually rearwardly by the cocking handle, the top of the cam follower 62 rides along beneath the flange 76 until it engages the depending forwardly inclined cam rib 78 which pivots the feed cam means 56 laterally until the cam follower engages within the trough of the feed cam means. Spring means is then employed to urge the forward end of the feed cam means 56 downwardly so that the trough will snap over and operatively engage with the cam follower 62. The spring means includes a coil compression spring 80 surrounding the stud 68 and engaged between the base of the latter and a washer 82 engaged beneath the feed lever 66. The top 60 of the cover assembly 54 is provided with a recess 84 in its undersurface to accommodate upward movement of the stud 68 against the downward urging of the spring 80, when the lateral flange 76 on the feed cam means 56 engages the top of the cam follower 62.

It thus will be seen that when the bolt assembly 16 is in its forward position, it can always be moved rearwardly to cock the weapon irrespective of whether the cover assembly 54 is open or closed, and further irrespective of whether the bolt assembly has been moved to its forward assembly with the cover assembly open.

Referring now to the FIG. 1B of the drawings, it will be seen that the weapon is provided with a carrying handle 86 having a grip 88 of heat-insulating material, e.g., plastic, secured to one leg of a generally U-shaped rod 90, the other leg of which is secured for pivotal movement about a longitudinal axis in a bracket 92 secured to the rear end of the barrel 10 just in advance of the receiver assembly 12. The grip 88, when the handle 86 is in carrying position, preferably is adjacent the center of gravity of the gun to facilitate carrying the latter with one hand. The handle 86 can be pivotally moved to one side or the other for unobstructed vision through the rear sight 94 when the gun is in use. It also will be seen, however, that when the pivot lock pin 14 is disengaged, the handle 86, because of its heat-insulating grip 88, can be used to remove a hot barrel from the gun without the use of heat-insulating hand coverings. Spare barrels will be supplied with such a carrying handle, but the necessity and expense of providing each barrel with such a handle outweighs the expense, nuisance and delay attendant the use of protective hand coverings for replacing a hot barrel with a cool spare.

Referring again to FIG. 1B of the drawings, there is shown a bipod supporting assembly 96 that is disclosed in somewhat greater detail in my copending application, Ser. No. 137,780, filed Apr. 7, 1980, the disclosure of which is incorporated by reference herein. As described therein, the bipod assembly 96 has a mounting structure which includes a ring member 98 secured to the forward end of a tube 100 on the receiver assembly 12 which encloses the operating rod 20. The ring member 98 is secured in place by a set screw 102 threaded through the member and engaged with the tube 100. The tip of the screw 102 is reduced for engagement within a pilot aperture 104 in the tube 100 for proper alignment of the bipod assembly 96 on the tube. Also secured to the ring member 98 is a depending pistol grip of lightweight material, e.g., plastic, having a socket 108 engaged with a depending complementary portion 110 on the ring member and held in place by the head of the screw 102.

By means of the foregoing construction, it will be seen that each gun need be provided with only one bipod supporting assembly 96, thus avoiding the necessity of providing such an assembly for each spare barrel. At the same time, there is provided a simple pistol grip 106 depending between the rearwardly foldable legs 112 of the bipod assembly 96 which increases the gunner's control of the weapon when firing in a standing position, either from the hip or from the shoulder.

Referring again to FIG. 1B of the drawings, the gas cylinder 40, which is of simple smooth bore construction, is secured beneath and to the barrel 10 by two integral ring members 114 which surround the barrel. Extending through the forward ring member 114 in alignment with the lower radial gas port 38 in the barrel 10 is a passageway 116 which communicates the port with the interior of the cylinder 40. The rear end of the cylinder 40 is reduced to fit snugly within and provide support for the forward end of the tube 100 which encloses the operating rod 20, and also provide a forwardly facing interior shoulder 118 engageable by the piston 42 which reciprocates in the cylinder. The forward end of the cylinder 40 is closed by a plug 120 which has a skirt 122 threadedly engaged within the cylinder and extending past the radial passageway 116 to form a stop for forward movement of the piston 42 effected by the operating rod 20. The inner end of the skirt 122 is notched, as at 124, in alignment with the passageway 116 to permit gas to flow from the passageway into the cylinder 40. Correct alignment of the notch 124 with the passageway 116 is assured by a notch 126 in the outer end of the plug 120 in longitudinal alignment with the notch 124. The plug 120 is held in place by a clamp nut 128 threaded onto the forward end of the cylinder 40. The plug 120 is installed by threading it into the cylinder 40 until the flange on the plug abuts the forward end of the cylinder. The plug is then unthreaded until the notch 126 is in vertical alignment with the barrel 10. The clamp nut 128 is then installed. The pitch of the threads on the plug 120 is greater than those in the nut 128 to eliminate the need for a locking wire or other securing means to hold the plug and nut in place. Opposite the inner end of the gas passageway 116, the cylinder is provided with a cleaning port 130 normally closed by the skirt 122 on the plug 120. When the latter is removed, however, a cleaning tool (not shown) can readily be inserted through the cleaning port 130 and through the gas passageway 116 to clean the gas port 38 in the barrel 10.

It thus will be seen that the objects and advantages of this invention have been fully and effectively achieved. It will be realized, however, that the foregoing specific embodiment has been disclosed only for the purpose of illustrating the principles of this invention and is susceptible of modification without departing from such principles. Accordingly, the invention includes all embodiments encompassed within the spirit and scope of the following claims.

I claim:

1. In a gas-operated machine gun having a cylinder secured to the gun barrel and parallel thereto, said cylinder having (1) a radial gas passageway for communicating with a radial gas port in the barrel and (2) a cleaning port opposite the gas passageway, the improvement comprising:

screw threads positioned within the cylinder and located solely forward of said gas passageway;

a plug threadably engaged with said screw threads within the forward end of the cylinder and positionable for closing the cleaning port, said plug having a forward threaded portion and a rear unthreaded portion, said unthreaded portion having notch means alignable with the gas passageway to communicate the latter with the cylinder through said notch means said threaded portion not extending forward of said passageway when said notch means is aligned with said passageway, said plug including indicia on the forward outer end of said plug in fixed alignment with said notch means for aligning said notch means with said gas passageway on installation of said plug; and clamp nut means for detachably retaining said plug in a fixed position relative to said cylinder.

2. In a gas-operated machine gun having a cylinder secured to the gun barrel parallel thereto with a radial gas passageway in the cylinder communicating with a radial gas port in the barrel and a cleaning port in the cylinder opposite the gas passageway, the improvement comprising:

a plug engaged within the forward end of the cylinder and closing the cleaning port, said plug having notch means in the inner end thereof aligned with the gas passageway to communicate the latter with the cylinder through said notch means;

indicia on the outer end of said plug aligned longitudinally with said notch means for aligning said notch means with said gas passageway on installation of said plug;

clamp nut means for detachably retaining said plug in said cylinder; and wherein said plug being threadedly engaged within the cylinder with threads of a pitch different from those on the clamp nut.

* * * * *